US007584722B2

(12) United States Patent
Sobotzik

(10) Patent No.: US 7,584,722 B2
(45) Date of Patent: Sep. 8, 2009

(54) VEHICLE ENGINE SYSTEM

(75) Inventor: Joachim Sobotzik, Lambsheim (DE)

(73) Assignee: Deere & Company, Moline, IL (US)

( * ) Notice: Subject to any disclaimer, the term of this patent is extended or adjusted under 35 U.S.C. 154(b) by 105 days.

(21) Appl. No.: 11/833,467

(22) Filed: Aug. 3, 2007

(65) Prior Publication Data

US 2008/0121195 A1 May 29, 2008

(30) Foreign Application Priority Data

Aug. 4, 2006 (DE) ..... 10 2006 036 589

(51) Int. Cl.
*F01P 7/02* (2006.01)

(52) U.S. Cl. ..... 123/41.11; 123/41.12; 123/41.49

(58) Field of Classification Search ..... 123/41.11, 123/41.12, 41.49, 41.46
See application file for complete search history.

(56) References Cited

U.S. PATENT DOCUMENTS 6,600,249 B2 * 7/2003 Nelson et al. ..... 123/41.12
7,051,786 B2 5/2006 Vuk

* cited by examiner

*Primary Examiner*—Noah Kamen

(57) ABSTRACT

The invention relates to a vehicle engine system. The engine system includes an internal combustion engine, a cooler of a cooling circuit, an electric generator driven by the engine from a side of the engine which is other than that which faces the cooler, and a fan for moving air through the cooler, all disposed in an engine compartment. An electric motor is powered by the generator and mechanically drives the fan through an output shaft which is mechanically connected to the fan. The output shaft of the motor is disposed in the engine compartment near a mechanical power take-off of the engine. The mechanical power take-off includes a belt pulley connected to a free end of an engine crankshaft.

16 Claims, 1 Drawing Sheet

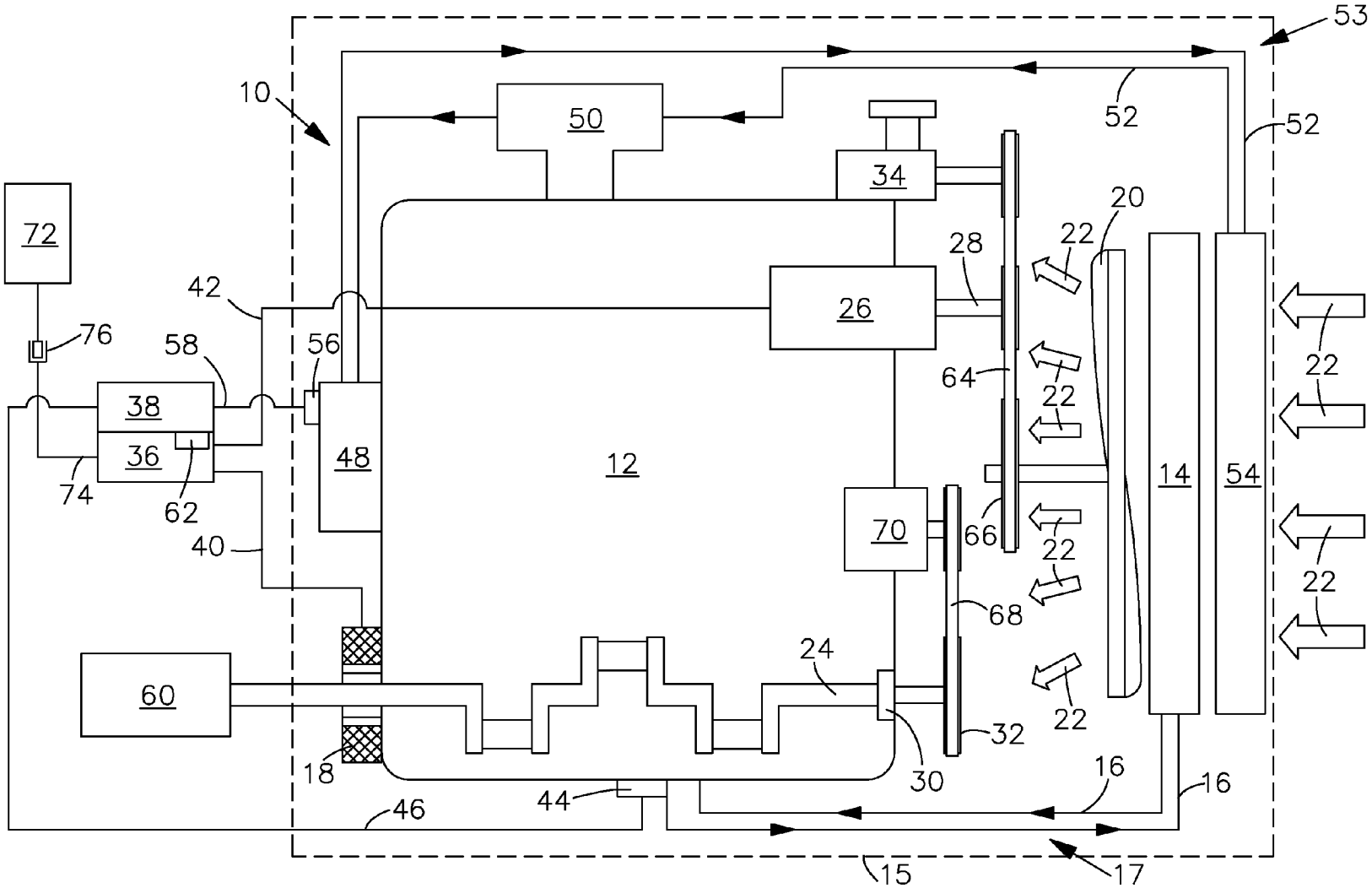
53
52
22
22
54
14
16
52
20
22
22
22
22
16
17
28
64
66
68
32
34
26
70
30
15
24
50
12
44
46
48
56
18
10
42
58
62
40
38
36
60
76
74
72

VEHICLE ENGINE SYSTEM

FIELD OF THE INVENTION

The present invention relates to an engine system for a vehicle, such as an agricultural or industrial utility vehicle.

BACKGROUND OF THE INVENTION

Agricultural or industrial utility vehicles have an engine system which includes an internal combustion engine, a cooler of a cooling circuit, a generator and a fan. The fan moves air through the cooler and is disposed adjacent to the cooler. The fan, the engine and the cooler are disposed in an engine compartment. Consequently, the fan could be disposed between the cooler and the engine or on that side of the cooler which faces away from the engine. In the latter case, the fan could be driven via a shaft which at one place is led through the cooler. The generator can be mechanically driven by the engine. The generator can be mechanically driven from a side of the engine which is other than that which faces the cooler. With the generator, electrical energy or electric power can be generated.

Engine systems of this type are known and used in passenger vehicles. In addition, these engine systems are commonly found in agricultural or industrial utility vehicles. However, at low driving speeds, high mechanical outputs must be engendered, for example in farm work with a tractor or in earth works with construction machinery. It is therefore necessary for a sufficient quantity of air to be moved constantly through the cooler with the aid of the fan. The output of the fan drive must therefore be sufficient to enable the engine to be sufficiently cooled even at low driving speeds.

Cooler fans are usually driven via a belt drive by the crankshaft of the engine. Consequently, a belt drive is normally mounted on the side of an engine which faces the cooler. With a belt or other mechanical fan drive, the cooler, because of the direct belt clutch, always has a rotation speed which is dependent on the speed of the engine, and the fan rotation speed cannot be tailored to the instantaneous cooling capacity requirement of the cooler. Fan speed could be varied with a belt adjusting gear mechanism between the belt pulley of the engine and the belt pulley of the fan. Such a solution, however, is costly and takes up a considerable installation space and is prone to repair, and involves a higher number of components.

Cooler fans in vehicles generate the air flow necessary to remove heat from the cooler or cooler element. The systems are designed for the so-called worst case, i.e. the operation of the vehicle under high load at low speeds and ambient temperatures. As already noted, the cooler fans are usually mechanically driven via a belt drive by the crankshaft of the vehicle. In order to reduce the drive output, a so-called Visco clutch, i.e. an element for the temperature-dependent rotation speed setting, is used. The rotation speed setting can be made solely in the "reduction" direction, i.e. the rotation speed of the fan is directly dependent on the rev speed of the engine, or less or zero if the Visco clutch is disengaged. This is based on the working principle of the generation of Viscous slip. A further possibility consists in the use of electromagnetically operated clutches.

Common to all previously used methods in the field of mechanical drives is the sole facility to reduce the rotation speed relative to that which would be produced by the transmission ratio of the belt drive. Hydrostatic drives can both reduce and increase the fan rotation speed. Their controllability, the usage characteristics at low temperatures, the small rotation speed adjustment range and unsatisfactory efficiency levels at higher rotation speeds constitute the associated drawbacks.

Electric fan drives are used in the automotive field. There are both two-point controller version (on/off), and rotation-speed-controlled drives in vehicles with high cooling capacity requirement. The fan drive capacities which are necessary in these vehicles amount to about 5-10% of the rated capacity of the engine and give rise to considerable requirements in terms of installation spaces and costs. Particularly, the direct drive version (i.e. the fan motor drives the fan without interposed gear mechanism) requires installation spaces which are not available in conventional engine compartments.

To use an electric fan drive in a utility vehicle, it is necessary to place the electric machine or motor in as favorable a position as possible. The volume of an electric motor is governed by the mechanical torque to be generated. Based on the power density, an electric motor offering the highest possible rotation speed is preferable. Engine compartments which are conventionally designed to drive the fan mechanically by the crankshaft via a belt drive do not permit the positioning of a direct-driving electric motor. A design alteration to the engine solely for this reason alone is out of the question.

SUMMARY OF THE INVENTION

Accordingly, an object of this invention is to provide an engine system wherein the fan is operable at a rotation speed which is tailored to the instantaneous cooling capacity requirements of the cooler or of the cooling system of the engine and is thus adjustable independently of the rev speed of the engine.

These and other objects are achieved by the present invention, wherein a vehicle engine system includes a fan driven by an electric motor powered by an engine driven generator.

Usually, a dynamo, such as an electric generator, is driven by a belt drive and a belt pulley on the power take-off of the engine, and is thus located in the engine compartment on or adjacent to the side of the engine which faces the cooler. This is because the same belt normally drives both the generator and the fan. In a manner according to the invention, the electric generator is mechanically driven from a side of the engine which is other than that which faces the cooler. The generator could be a crankshaft generator as described in DE 10 2004 052 023, where the generator is disposed on that side of the engine which faces the gearbox downstream of the engine. The rotor of the generator is driven by the crankshaft of the engine, with which the gearbox and the traveling drive are also driven. This crankshaft generator is a asynchronous machine, which generates alternating current of a frequency which is dependent on the instantaneously speed of the engine. This current is converted to direct current by means of an AC/DC converter and is fed to a direct-current intermediate circuit. When an electric machine is operated with alternating current, between the direct-current intermediate circuit and the electric machine, a DC/AC converter should be provided, with which the direct current is converted into alternating or rotary current of appropriate frequency.

With at least a part of the current generated by the generator, an electric motor can then be driven, which in turn mechanically drives the fan. The motor is positioned in the engine compartment on or adjacent to a side of the engine which faces the cooler, such as where the conventional generator is usually mounted.

The electric motor could have an output shaft which mechanically drives the fan. Usually the rotor of the electric motor is rigidly connected to the output shaft. However, the rotor of the electric motor could be connected to the output shaft via an intermediate gearbox. This would be advantageous when the electric motor is operated at a very high rotation speed, though the initial rotation speed at which the fan is driven is designed to be less than the initial rotation speed of the electric motor.

Preferably, the electric motor is disposed in the engine compartment so that its output shaft is near the mechanical power take-off of the engine. Such a mechanical power take-off could be, for example, a free end of the engine crankshaft, upon which is mounted a belt pulley. The belt pulley drives the cooler fan, a coolant pump, an engine oil or gearbox oil pump, a generator and/or an air compressor. Since the fan drive shaft is usually disposed near the belt pulley, yet the fan is not driven by the belt directly from the engine, the electric motor and its output shaft are expediently likewise disposed in this region, so that the fan can be mechanically driven by the electric motor. Consequently, it is not necessary to alter the engine with an additional or modified mechanical power take-off. In addition, the mounting site of the cooler and the fan, as well as the other auxiliary units, can remain unaltered.

In one embodiment of the present invention, the electric motor could be located on the engine where normally a generator is located.

Preferably, further consumer units, such as an air compressor, can be mechanically driven with the electric motor. These consumer units can also be operated as a function of the instantaneous or currently prevailing power demand of the vehicle.

A power electronics component commanded by a control device is provided to enable the electric motor and/or of the generator to be efficiently commanded or controlled in accordance with the currently prevailing load state of the vehicle. The power electronics component controls the rotational direction, rotation speed and/or the torque of the electric motor as commanded.

In a preferred embodiment, at least one temperature sensor is provided to sense the temperature of a component, the coolant or oil. The temperature sensor generates a signal which can be transmitted to a control device.

Preferably, the fan is connected to the motor by a flexible drive, such as a belt and pulley driven by an engine crankshaft. In other words, the fan could be mounted just as before and at the traditional mounting site usually provided, but driven, not by a belt via the belt pulley of the engine, but rather, via a belt driven by a belt pulley of the electric motor. Thus, only the belt drive for the water and/or oil pump has to be modified so that the fan is no longer driven with this belt drive. The flexible drive could have a belt, a V-belt, V-ribs, a toothed belt or a chain.

The electric motor can be fitted in place of the dynamo and a belt drive can be provided to drive the fan, provided that the generator powering the electric motor is fitted at a different mounting site. The construction of the engine compartment components can thereby be modular and economical, particularly in the mass production of traditional vehicles and vehicles having a fan driven according to the invention, for this is feasible with a small number of different parts.

An intermediate gearbox could be provided between the electric motor and the fan. The transmission ratio can be adjusted to adjust the rotation speed of the fan, so that the electric motor can be operated at a higher rotation speed and the fan at a lower rotation speed. Since the costs of a direct-driving electric motor, i.e. running at fan rotation speed (with correspondingly lower rotation speed), are higher than those of a machine of equal power at a higher rotation speed level, the combination of an electric motor at high rotation speed level in conjunction with an intermediate or transmission gearbox can yield a reduction in costs. The transmission ratio could in this case lie—as also, however, in a pure belt drive of the fan of the electric motor with predefined transmission ratio—within similar ranges to those with the dynamo, i.e. roughly 1:3 to 1:4. The relatively high rotation speeds which are thereby obtained advantageously lead to a compact machine design and, in relation to a direct drive, correspondingly reduced costs for the electric motor. Since the rotation speeds and the size of the parts rotating within the machine are roughly equivalent to those of a dynamo, no drawback with regard to service life is expected.

As already indicated, the generator could be an asynchronous alternating current generator. A direct-voltage converter could convert the alternating voltage into DC voltage. The converted DC voltage could be fed to a DC intermediate circuit.

A frequency converter, preferably part of the power electronics unit, could covert the DC voltage (for example of the DC intermediate circuit) into AC voltage such that the electric motor can be operated at a variable predefined rotation speed. This rotation speed can then be chosen such that the expected air movement through the cooler, generated by the fan, yields a predefined necessary cooling capacity. Ultimately, the rotation speed of the electric motor can be commanded according to at least one of the above-stated command strategies.

BRIEF DESCRIPTION OF THE DRAWINGS

The sole FIGURE is a schematic diagram of a vehicle engine system embodying the invention.

DESCRIPTION OF THE PREFERRED EMBODIMENT

The single FIGURE shows an engine system 10 for an agricultural utility vehicle, such as a tractor (not shown). The engine system 10 includes an internal combustion engine 12, a cooler 14 of a cooling circuit 17, a generator 18 and a fan 20. The engine 12, the cooler 14 and the generator 18 are disposed in an engine compartment 15 of the tractor. The cooling circuit 17 includes lines 16 which convey engine coolant through the engine 12 and the cooler 14.

Fan 20 moves air through the cooler 14, as indicated with the arrows 22. Since the fan 20 is disposed between the cooler 14 and the engine 12, the fan 20 sucks in air from that side of the engine 12 which faces away from the cooler 14.

The generator 18 generates electrical energy and is mechanically driven by the crankshaft 24 of the engine 12. The generator 18 is disposed on the side of the engine 12 which faces away from the cooler 14. Preferably, the generator 18 is a crankshaft generator.

According to the invention, an electric motor or motor 26 is driven or powered by the electrical energy generated by the generator 18. The motor 26 in turn mechanically drives the fan 20. The motor 26 has an output shaft 28, via which the fan 20 can be mechanically driven.

The motor 26 is disposed in the engine compartment 15 such that the output shaft 28 of the motor 26 is disposed in a region of the engine compartment 15 which has a mechanical power take-off 30 of the engine 12. The mechanical power take-off 30 is a free end of the engine crankshaft, which is connected to a belt pulley 32. The motor 26 is disposed at an installation site on the engine 12 where a traditional dynamo is usually provided. In addition to the fan 20, the motor 26, may mechanically drive further consumer units, such as a compressed-air compressor 34.

The system also includes a power electronics unit 36. Electric current generated by the generator 18 is fed to the power electronics unit 36 via the power supply line 40. The power electronics unit 36 is connected to generator 18 via the power supply line 42, and is commanded by a control device 38 so that the rotational direction and/or the rotation speed and/or the torque of the motor 26 can be commanded.

A temperature sensor 44 senses the temperature of the coolant of the cooling circuit 17 and generates electric signals, which are dependent on the detected temperature and which are fed to the control device 38 via the line 46. A command strategy is provided such that the rotation speed of the motor 26 is controllable as a function of the coolant temperature of the cooling circuit 16.

The oil cooler 48 cools engine oil and receives coolant (in this case a water-glycerol mixture), so that the oil cooler 48 is an oil-water heat exchanger. A charge-air cooler 50 of the engine 12 is also provided. Both the oil cooler 48 and the charge-air cooler 50 are cooled with coolant of the further cooling circuit 53. The further or secondary cooling circuit 53, with connecting lines 52, has an air-coolant heat exchanger 54, which is disposed on that side of the cooler 14 which faces away from the fan 20. In a further control or adjustment strategy, the rotation speed of the motor 26 is commanded as a function of the oil temperature of the engine 12. The oil temperature is sensed by temperature sensor 56, which also generates an electric signal which is dependent on the detected temperature and which is fed via the line 58 to the control device 38.

In the command of the rotation speed of the motor, the control or adjustment strategy of the control device 38 also takes account of the instantaneous power demand of the compressed-air compressor 34.

The power electronics unit 36 has a temperature sensor 62, which generates an electric signal which is dependent on the detected temperature and is transmitted to the control device 38. The rotation speed or the torque of the motor is commanded also as a function of the temperature of the power electronics 36, to be precise such that the power electronics 36 cannot get overheated.

The fan 20 and the compressed-air compressor 34 are driven via flexible means 64 by the motor 26. The flexible drive 64 is configured in the form of a V-belt. The fan 20 has a belt pulley 66. The belt pulley 32 of the mechanical power take-off 30 of the engine 12 drives via a belt 68 the oil pump 70. Although not shown in the Figure, the belt pulley 66, and hence the fan 20, could be arranged so that it could be driven by a belt driven by the belt pulley 32 of the engine 12.

The generator 18 is preferably an alternating current generator. The power electronics unit 36 has a direct-voltage converter (not shown), with which the alternating voltage generated by the generator 18 is convertible into direct voltage. The power electronics unit 36 includes a frequency converter (not shown) which converts the direct voltage into alternating voltage such that the motor 26 can be operated with a variable pre-definable rotation speed.

The engine 12 drives a gearbox or traveling drive 60 of the utility vehicle. Gearbox oil of the gearbox 60 could be connected up to (not shown) and cooled by a cooling circuit, such as the further cooling circuit 52.

A working tool (not shown) adaptable to the tractor includes an electric consumer unit 72 which is supplied with electric current by the power electronics unit 36 via the line 74 when the working tool is adapted to the tractor. To this end, a plug connection 76 is provided between the vehicle and the consumer unit 72.

The rotation speed and/or the torque of the electric motor can be controlled as a function of the coolant temperature of the cooling circuit, or a further cooling circuit. If the coolant temperature is higher, the rotation speed of the fan is increased accordingly. This allows a command and control system which conforms to requirement and is tailored to the currently prevailing load state of the vehicle cooling system.

Additionally or alternatively, the rotation speed and/or the torque of the electric motor could be controllable as a function of the oil temperature of the engine, of the drive train and/or of a vehicle hydraulics. This allows a command and control system which conforms to requirement and is tailored to the currently prevailing load state of the engine and/or of the drive train or of the components of the vehicle hydraulics.

The rotation speed and/or the torque of the electric motor could also be controlled as a function of the power demand of further electrical consumer units of the vehicle, such as an air-conditioning system. In this case, a corresponding command system for the generator can also be incorporated. For example, the electric power supplied to the fan could be reduced where a further electrical consumer unit has to be powered and the coolant temperature of the cooling circuit permits this.

Particularly in the case of an agricultural utility vehicle, for instance a tractor, a working tool coupled to the utility vehicle could be at least partly electrically operated. An electrical consumer unit of the working tool could be powered by the generator of the utility vehicle. Also, the rotation speed and/or the torque of the electric motor could be controlled as a function of the power demand of an electrical consumer unit of such a working tool, such as a drilling or sowing machine.

In addition, the rotation speed and/or the torque of the electric motor could be controlled as a function of the demand of a air compressor, or as a function of the temperature of the coolant of a secondary cooling circuit. This is particularly of interest when the fan is used to move air through a cooler of the secondary cooling circuit. In comparable manner, the rotation speed and/or the torque of the electric motor could therefore be actuated as a function of the temperature of a charge-air cooler and/or the coolant temperature of a cooling circuit.

Such a control system could also respond to the operating temperature of the power electronics or of the power electronics unit, so that the rotation speed and/or the torque of the electric motor can be commanded as a function of the temperature of the power electronics.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A vehicle engine system having an internal combustion engine, a cooler of a cooling circuit, a generator generating electrical energy and mechanically driven by the engine from a side of the engine which is other than that which faces the cooler, and a fan adjacent to the cooler for moving air through the cooler, the fan, the engine and the cooler being disposed in an engine compartment, characterized by:

an electric motor powered by the electrical energy generated by the generator and mechanically driving the fan and the electric motor mechanically drives a further power consumer unit.

2. The vehicle engine system of claim 1, wherein:

the electric motor has an output shaft which is mechanically connected to the fan.

3. The vehicle engine system of claim 2, wherein:

the electric motor has an output shaft which is disposed in a portion of the engine compartment, and the engine has a mechanical power take-off which is also disposed in said portion of the engine compartment.

4. The vehicle engine system of claim 3, wherein:

the mechanical power take-off comprises a belt pulley connected to a free end of an engine crankshaft.

5. The vehicle engine system of claim 1, further comprising:

a power electronics unit which controls the rotational direction and/or the rotation speed and/or the torque of the electric motor in response to a control device.

6. The vehicle engine system of claim 5, wherein:

the power electronics unit controls the rotation speed and/or the torque of the electric motor as a function of a temperature sensed by at least one temperature sensor.

7. The vehicle engine system of claim 6, wherein:

the temperature sensor senses a temperature of at least one of a group of vehicle systems including a cooling circuit, engine oil, drive train and hydraulics.

8. The vehicle engine system of claim 6, wherein:

the temperature sensor senses a temperature of a coolant of a secondary cooling circuit.

9. The vehicle engine system of claim 6, wherein:

the temperature sensor senses a temperature of a charge-air cooler.

10. The vehicle engine system of claim 1, further comprising:

at least one temperature sensor which senses a temperature of a vehicle system and transmits a signal to a control device.

11. The vehicle engine system of claim 1, wherein:

the generator comprises an AC generator, and a CD-voltage converter converts an AC voltage generated by the generator into a DC voltage.

12. A vehicle engine system having an internal combustion engine, a cooler of a cooling circuit, a generator generating electrical energy and mechanically driven by the engine from a side of the engine which is other than that which faces the cooler, and a fan adjacent to the cooler for moving air through the cooler, the fan, the engine and the cooler being disposed in an engine compartment, characterized by:

an electric motor powered by the electrical energy generated by the generator and mechanically driving the fan; and a power electronics unit which controls the rotational direction and/or the rotation speed and/or the torque of the electric motor in response to a control device, the power electronics unit controlling the electric motor as a function of a power demand of a consumer of electrical power other than the cooling fan.

13. A vehicle engine system having an internal combustion engine, a cooler of a cooling circuit, a generator generating electrical energy and mechanically driven by the engine from a side of the engine which is other than that which faces the cooler, and a fan adjacent to the cooler for moving air through the cooler, the fan, the engine and the cooler being disposed in an engine compartment, characterized by:

an electric motor powered by the electrical energy generated by the generator and mechanically driving the fan; and a power electronics unit which controls the rotational direction and/or the rotation speed and/or the torque of the electric motor in response to a control device, the power electronics unit controlling the electric motor as a function of a power demand of a consumer of electrical power which is part of a working tool which can be coupled to the vehicle.

14. A vehicle engine system having an internal combustion engine, a cooler of a cooling circuit, a generator generating electrical energy and mechanically driven by the engine from a side of the engine which is other than that which faces the cooler, and a fan adjacent to the cooler for moving air through the cooler, the fan, the engine and the cooler being disposed in an engine compartment, characterized by:

an electric motor powered by the electrical energy generated by the generator and mechanically driving the fan; and a power electronics unit which controls the rotational direction and/or the rotation speed and/or the torque of the electric motor in response to a control device, the power electronics unit controlling the electric motor as a function of a demand of an air compressor.

15. A vehicle engine system having an internal combustion engine, a cooler of a cooling circuit, a generator generating electrical energy and mechanically driven by the engine from a side of the engine which is other than that which faces the cooler, and a fan adjacent to the cooler for moving air through the cooler, the fan, the engine and the cooler being disposed in an engine compartment, characterized by:

an electric motor powered by the electrical energy generated by the generator and mechanically driving the fan; and a power electronics unit which controls the rotational direction and the rotation speed and/or the torque of the electric motor in response to a control device, the power electronics unit controlling the rotation speed and/or the torque of the electric motor as a function of a temperature sensed by at least one temperature sensor.

16. A vehicle engine system having an internal combustion engine, a cooler of a cooling circuit, a generator generating electrical energy and mechanically driven by the engine from a side of the engine which is other than that which faces the cooler, and a fan adjacent to the cooler for moving air through the cooler, the fan, the engine and the cooler being disposed in an engine compartment, characterized by:

an electric motor powered by the electrical energy generated by the generator and mechanically driving the fan; and a power electronics unit which controls the rotational direction and/or the rotation speed and/or the torque of the electric motor in response to a control device, the power electronics unit including a frequency converter which converts a DC voltage into an AC voltage so that the electric motor can be operated at a variable desired rotation speed.

* * * * *